US006864857B2

(12) United States Patent
Crouch et al.

(10) Patent No.: US 6,864,857 B2
(45) Date of Patent: Mar. 8, 2005

(54) OPTICALLY TRANSPARENT MILLIMETER WAVE REFLECTOR

(75) Inventors: David D. Crouch, Corona, CA (US); William E. Dolash, Montclair, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/044,691

(22) Filed: Jan. 10, 2002

(65) Prior Publication Data

US 2003/0128171 A1 Jul. 10, 2003

(51) Int. Cl.[7] ..... H01Q 15/14

(52) U.S. Cl. ..... 343/912; 343/909

(58) Field of Search ..... 428/426; 333/252; 343/909, 912

(56) References Cited

U.S. PATENT DOCUMENTS

| | | | | |
|---|---|---|---|---|
| 5,488,371 A | | 1/1996 | Targove | |
| 5,776,612 A | * | 7/1998 | Fisher | 428/426 |
| 6,522,226 B2 | * | 2/2003 | Crouch et al. | 333/252 |

FOREIGN PATENT DOCUMENTS

JP 10 290109 A 10/1998

OTHER PUBLICATIONS

Pat. Abstracts of Jap. Sumitomo Metal Ind. Ltd. Jan. 29, 1999 vol. 1999 No. 01 Abstract.

Janos W A; Synthetic dielectric material for broadvand–selective absorption and reflection: IEEE Antennas and Propagation Society International Symposium, 1995 Digest (Cat. No. 95CH35814), IEEE Antennas and Propagation.

Society International Symposium, 1995 Digest, Newport Beach, CA, USA, Jun. 18–23, 1995, pp. 1852–1855 vol. 4, XP002240014 1995, New York, HY, USA, IEEE, USA ISBN: 0–7803–2719–5 the whole document.

* cited by examiner

*Primary Examiner*—Frank G. Font
*Assistant Examiner*—Eric Wong
(74) *Attorney, Agent, or Firm*—Thomas J. Finn; Leonard A. Alkov; Karl A. Vick

(57) ABSTRACT

An optically transparent dielectric reflector (200) that reflects an incident millimeter-wave beam at a design frequency. The reflector (200) includes layers of different optically transparent dielectric materials. The thickness of the individual layers is chosen so that the transmitted waves cancel almost completely in the forward direction, yielding a high degree of transmission loss and substantial reflection. In the preferred embodiment, the invention is comprised of alternating layers of optical sapphire and air. In the best mode, there are seven sapphire layers, with outer sapphire layers (50) having a nominal thickness of 70.8 mils, inner sapphire layers (52) with a nominal thickness of 30.4 mils, and air layers have a nominal thickness of 32.0 mils Vented metal spacers (54) are used to maintain optimal thickness of air layers.

13 Claims, 6 Drawing Sheets

TOLERANCE ANALYSIS OF SEVEN-LAYER REFLECTOR. $|\Delta L| \leq 0.5$ MILS. $|\Delta D| \leq 1.0$ mils.

VARIATION OF TRANSMISSION COEFFICIENT WITH POLARIZATION ANGLE AR 95 GHz.

OPTICALLY TRANSPARENT MILLIMETER WAVE REFLECTOR

BACKGROUND OF THE INVENTION

1. Field of the Invention

The present invention relates to optical and millimeter-wave systems. More specifically, the present invention relates to devices used to reflect millimeter-wave frequencies and transmit optical frequencies.

2. Description of the Related Art

High-power millimeter-wave systems sometimes require the placement of lasers and/or cameras in the path of the millimeter-wave beam. In order to prevent damage to the equipment, a shield needs to be placed in the path of the beam. The shield needs to be almost totally reflective at millimeter-wave frequencies and transparent at optical frequencies.

In material processing applications, for instance, millimeter-waves may be used inside a reaction chamber to fabricate a synthetic substance. It may be necessary or desirable to place a window in the chamber in order to observe the reaction taking place within. This window needs to transmit optical frequencies without distorting them, while blocking transmission of the millimeter-waves.

Previous attempts to solve this problem have used either metal meshes or absorptive water-filled windows. Metal meshes are effective at reflecting nearly all of the incident radiation, but they are only marginally transparent at optical frequencies.

While the performance of absorptive water-filled windows is superior to that of metal meshes, they are subject to several problems. First, they may be prone to leaks after extended use. In addition, the perception exists among users than an incident millimeter-wave beam of sufficient intensity could cause the water to boil, which could lead to catastrophic failure of the window. Finally, it has been observed experimentally that when an absorptive water window is radiated by a high-power millimeter-wave beam, the absorbed power initiates convection currents in the water that scatters incident light, degrading the images captured by a camera behind the window.

Hence, a need exists in the art for a system or method for reflecting millimeter-wave frequencies and transmitting optical frequencies without distorting the optical frequencies.

SUMMARY OF THE INVENTION

The need in the art is addressed by the present invention, an optically transparent dielectric reflector that reflects an incident millimeter-wave beam at a design frequency. This behavior is achieved by constructing the reflector from layers of different optically transparent dielectric materials and choosing the thickness of the individual layers so that the transmitted waves cancel almost completely in the forward direction, yielding a high degree of transmission loss and a high (e.g., nearly 100%) reflection.

In the preferred embodiment, the invention is comprised of alternating layers of optical sapphire and air. In the best mode, there are seven sapphire layers, with outer layers having a nominal thickness of 70.8 mils, inner sapphire layers with a nominal thickness of 30.4 mils, and air layers have a nominal thickness of 32.0 mils. Vented metal spacers are used to maintain optimal thickness of air layers.

Unlike the absorptive water-filled windows of the prior art, the invention reflects, rather than absorbs, an incident millimeter-wave beam, while transmitting incident optical radiation. Because no liquids are involved, the possibility of leakage is eliminated. Since the incident millimeter-wave energy is reflected rather than absorbed, the possibility of heat-induced damage or failure is greatly reduced. Finally, the quality of the optical images captured by a camera behind an optically-transparent millimeter-wave reflector is expected to be superior since there are no convection currents present to scatter the incident light.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention is an optically transparent dielectric reflector that in an illustrative embodiment may reflect nearly 100% of an incident millimeter-wave beam at the design frequency. This behavior is achieved by constructing the reflector from alternating layers of different optically transparent dielectric materials, choosing the thickness of the individual layers so that the transmitted waves cancel almost completely in the forward direction, yielding a high degree of transmission loss and nearly 100% reflection.

Unlike the absorptive water-filled windows of the prior art, the invention reflects, rather than absorbs, an incident millimeter-wave beam, while transmitting incident optical radiation. Because no liquids are involved, the possibility of leakage is eliminated. Since the incident millimeter-wave energy is reflected rather than absorbed, the possibility of heat-induced damage or failure is greatly reduced. Finally, the quality of the optical images captured by a camera behind an optically-transparent millimeter-wave reflector is expected to be superior since there are no convection currents present to scatter the incident light.

Figure 1A:
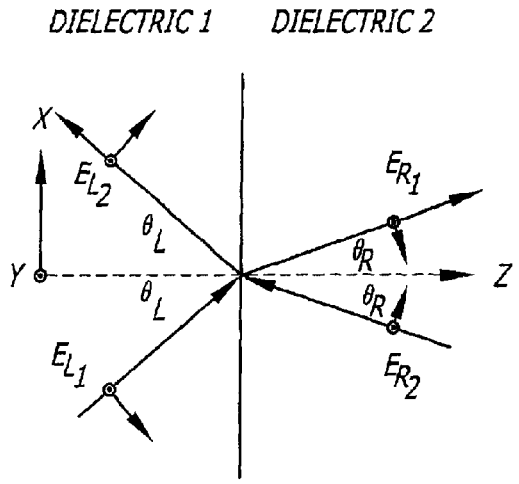
FIG. 1*a* is a diagram showing TE waves incident on a dielectric boundary.
Figure 1B:
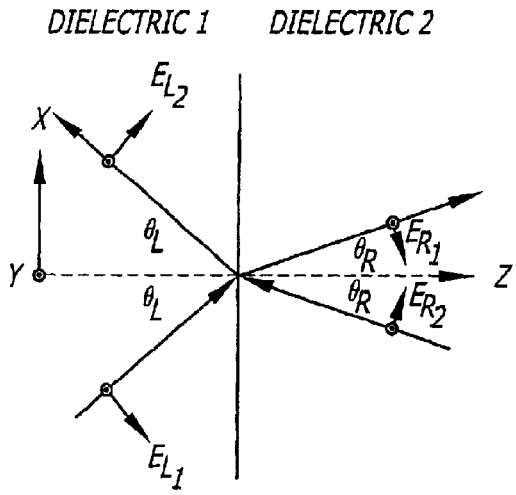
FIG. 1*b* is a diagram showing TM waves incident on a dielectric boundary.

To understand how such a reflector can be constructed, first consider a plane wave incident at an oblique angle on an interface between two dielectric materials. When the polarization of the plane wave is taken into account, there are two different physical scenarios that must be considered. If the electric field of the plane wave is parallel to the interface, as illustrated in FIG. 1*a*, the incident wave is said to be a transverse electric, or TE wave. On the other hand, if the magnetic field of the incident wave is parallel to the interface, as illustrated in FIG. 1*b*, the wave is said to be a transverse magnetic, or TM wave. Note that an arbitrarily polarized plane wave can be represented as a superposition of a TE and a TM wave.

For an incident plane wave (TE or TM), the relationship between the incident, reflected, and transmitted waves can be cast in the form of a transmission matrix, which relates the incident and reflected waves on the left side of the boundary to those on the right. This matrix relationship takes the form:

$$\begin{bmatrix} E_{L_1} \\ E_{L_2} \end{bmatrix} = \begin{bmatrix} T_{11}^{TE,TM} & T_{12}^{TE,TM} \\ T_{21}^{TE,TM} & T_{22}^{TE,TM} \end{bmatrix} \begin{bmatrix} E_{R_1} \\ E_{R_2} \end{bmatrix}, \quad [1]$$

where $E_{L_1}$ and $E_{L_2}$ are the incident and reflected waves to the left of the boundary, respectively, and $E_{R_1}$ and $E_{R_2}$ are the transmitted and incident waves to the right of the boundary, as illustrated in FIG. 1.

For the TE case, the elements of the transmission matrix are given by:

$$T_{11}^{TE} = T_{22}^{TE} = \frac{1}{2}\left(1 + \frac{\eta_L \cos\theta_R}{\eta_R \cos\theta_L}\right), \quad [2]$$

$$T_{12}^{TE} = T_{21}^{TE} = \frac{1}{2}\left(1 - \frac{\eta_L \cos\theta_R}{\eta_R \cos\theta_L}\right), \quad [3]$$

and for the TM case, the elements of the transmission matrix are given by:

$$T_{11}^{TM} = T_{22}^{TM} = \frac{1}{2}\left(\frac{\eta_L}{\eta_R} + \frac{\cos\theta_R}{\cos\theta_L}\right), \quad [4]$$

$$T_{12}^{TM} = T_{21}^{TM} = -\frac{1}{2}\left(\frac{\eta_L}{\eta_R} - \frac{\cos\theta_R}{\cos\theta_L}\right). \quad [5]$$

Here $\theta_R$ and $\theta_L$ are the angles made by the incident and reflected waves with the direction normal to the dielectric boundary on the right and left sides of the dielectric boundary, respectively, and $\eta_R$ and $\eta_L$ are the characteristic impedances of the corresponding materials.

In addition to the transmission matrix for a dielectric interface, the transmission matrix describing propagation of a plane wave through a uniform dielectric slab is also required. The appropriate transmission matrix for either a TE or a TM wave propagating at an angle $\theta_R$ with respect to the z axis through a material having an index of refraction n is given by:

$$\begin{bmatrix} E_{L_1} \\ E_{L_2} \end{bmatrix} = \begin{bmatrix} \exp(jk_0 nd\cos\theta_R) & 0 \\ 0 & \exp(-jk_0 nd\cos\theta_R) \end{bmatrix} \begin{bmatrix} E_{R_1} \\ E_{R_2} \end{bmatrix}. \quad [6]$$

Here $k_0=2\pi/\lambda_0$, where $\lambda_0$ is the free space wavelength of the incident plane wave, and d is the thickness of the slab of material.

The angle $\theta_R$ can be related to $\theta_L$ via Snell's law of refraction, i.e.:

$$n_L \sin\theta_L = n_R \sin\theta_R. \quad [7]$$

The advantage of the transmission matrix formulation is that the reflection and transmission coefficients for composite structures composed of multiple dielectric layers can be calculated easily simply by multiplying in sequence the transmission matrices for the individual layers. In general, the reflection and transmission coefficients of an m-layer structure constructed from dielectric slabs of different materials each having a different thickness can be calculated in the following manner.

One starts at the left-most boundary, where the incident plane wave encounters the first dielectric interface. At this interface, $\theta_L=\theta_{inc}$, where $\theta_{inc}$ is the angle made by the incident plane wave with the z axis. Given the value of $\theta_L$, the angle $\theta_R$ at which plane waves propagating to the left and right in the material to the right of the boundary can be calculated. The transmission matrices for the first boundary and for propagation through the first dielectric layer can then be calculated.

By repeated application of Snell's law, the value of $\theta_R$ in each succeeding layer can be calculated given the value of $\theta_L$ in the preceding layer. In this way, transmission matrices for each element of a composite structure can be calculated. The transmission matrix of the composite structure is then obtained as a matrix product of the individual transmission matrices. If the transmission matrix of the first dielectric interface is denoted by $T_{1a}$, that of the first slab by $P_1$, and that of the second dielectric interface by $T_{1b}$, then the transmission matrix of the composite single-layer structure is given by:

$$T_1 = T_{1a} \times P_1 \times T_{1b}. \quad [8]$$

Consider a structure composed of m layers of a particular dielectric material, with each layer separated from the next by a gap that may be filled with air or with some other dielectric material. If there are m layers, there will be m-1 gaps. If the transmission matrices of the individual layers are denoted by $T_1, T_2, \ldots, T_m$, and the transmission matrices of the gaps by $G_1, G_2, \ldots, G_{m-1}$, then the transmission matrix of the composite structure is:

$$T = T_1 \times G_1 \times T_2 \times G_2 \ldots T_{m-1} \times G_{m-1} \times T_m, \quad [9]$$

where the transmission matrix of the $k^{th}$ dielectric layer is given by:

$$T_k = T_{ka} \times P_k \times T_{kb}. \quad [10]$$

Assuming that a plane wave is incident only from the left, the relationship between the incident wave and the waves reflected and transmitted by the composite structure is given by:

$$\begin{bmatrix} E_{inc} \\ E_{ref} \end{bmatrix} = \begin{bmatrix} T_{11} & T_{12} \\ T_{21} & T_{22} \end{bmatrix} \begin{bmatrix} E_{trans} \\ 0 \end{bmatrix}. \quad [11]$$

One can easily show that the power reflection and transmission coefficients R and T of the composite structure are given in terms of the elements of the transmission matrix by:

$$R = \left|\frac{E_{ref}}{E_{inc}}\right|^2 = \left|\frac{T_{21}}{T_{11}}\right|^2, \quad [12]$$

$$T = \left|\frac{E_{trans}}{E_{inc}}\right|^2 = \left|\frac{1}{T_{11}}\right|^2. \quad [13]$$

The intent here is to develop a multi-layer structure that will reflect nearly all of the incident radiation at a particular millimeter-wave frequency while allowing light to pass. That is, to minimize the transmission coefficient T of the composite structure.

To minimize the cost and complexity of the final structure, it is desirable to minimize the total number of layers. The number of layers is a function of the degree to which the transmitted waves are to be attenuated and of the dielectric constants of the materials to be used. To minimize the number of layers, the difference in dielectric constants between neighboring layers should be as high as possible in order to maximize the reflection coefficient at each dielectric interface. By separating successive dielectric layers by air gaps, the maximum possible contrast in dielectric constant is obtained.

The choice of dielectric material is constrained by the requirements that it be optically transparent and have a low loss tangent at millimeter-wave frequencies. Optical sapphire (single-crystal $Al_2O_3$) is one possible choice, as it has a relatively high dielectric constant of 9.41 for zero-cut material (in which the optic axis is perpendicular to the surface of the material) and a low loss tangent of $8\times10^{-4}$ at 95 GHz. In addition, it is extremely hard and is resistant to common acids and alkalis, making it suitable for use in harsh environments.

The transmission matrices described above were used to design a reflector for use with plane waves incident at an angle of 13.5°. The final design is required to attenuate transmitted TE and TM waves by approximately 60 dB. It was determined that seven layers of sapphire separated by air gaps could meet this requirement.

Figure 2:
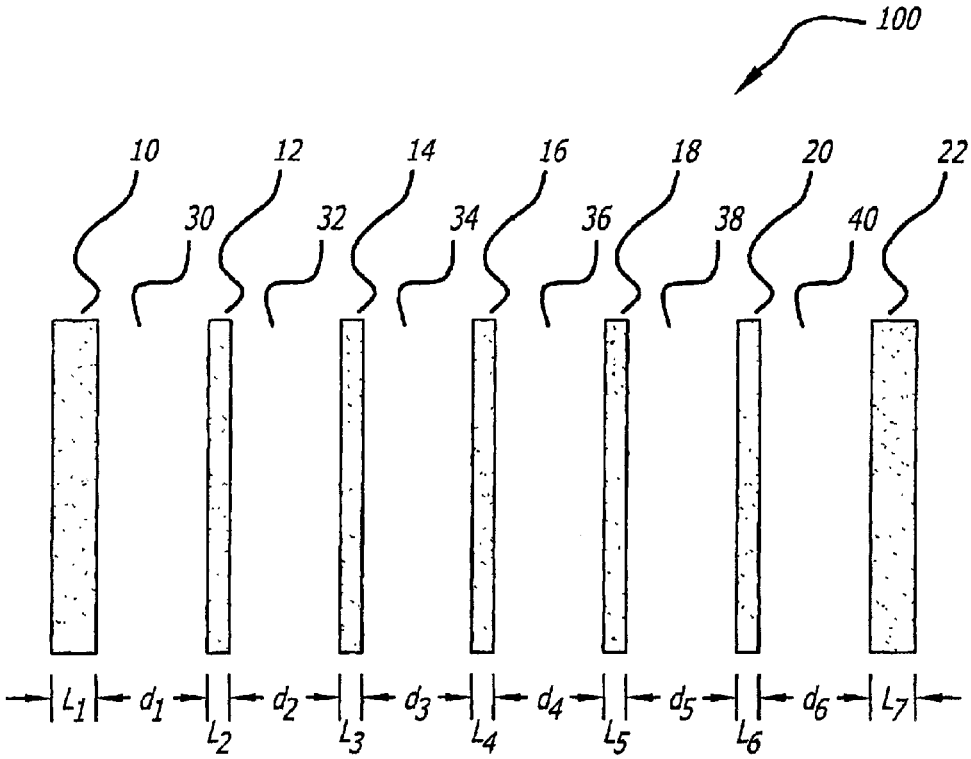
FIG. 2 is a diagram of an optically transparent millimeter wave reflector designed in accordance with the teachings of the present invention.

FIG. 2 is a diagram of an optically transparent millimeter wave reflector 100 designed in accordance with the teachings of the present invention. In the illustrative embodiment, the reflector 100 is comprised of seven sapphire plates (10, 12, 14, 16, 18, 20, 22) separated by air gaps (30, 32, 34, 36, 38, 40). The dimensions of the sapphire layers and the air gaps separating them are as follows:

$$L_1=L_7=70.8\pm0.4 \text{ mils},$$

$$L_2=L_3=L_4=L_5=L_6=30.4\pm0.3 \text{ mils},$$

$$d_1=d_2=d_3=d_4=d_5=d_6=32.0\pm0.5 \text{ mils},$$

where $L_i$ is the width of the i-th sapphire plate, and $d_j$ is the width of the j-th air gap.

As the outermost plates will be the only plates directly exposed to the environment, they are made thicker than the inner plates (plates 2 through 6) in order to provide them with greater mechanical strength. The tolerances of ±0.4 mils on $L_1$ and $L_7$ and ±0.3 mils on $L_2$ through $L_6$ are not performance driven. That is, the reflector will still work with only a slight degradation in performance if the tolerances are relaxed somewhat, as the performance of the reflector is not overly sensitive to the dimensions of the sapphire plates or to the dimensions of the gaps, as shown in FIG. 2.

Figure 3:
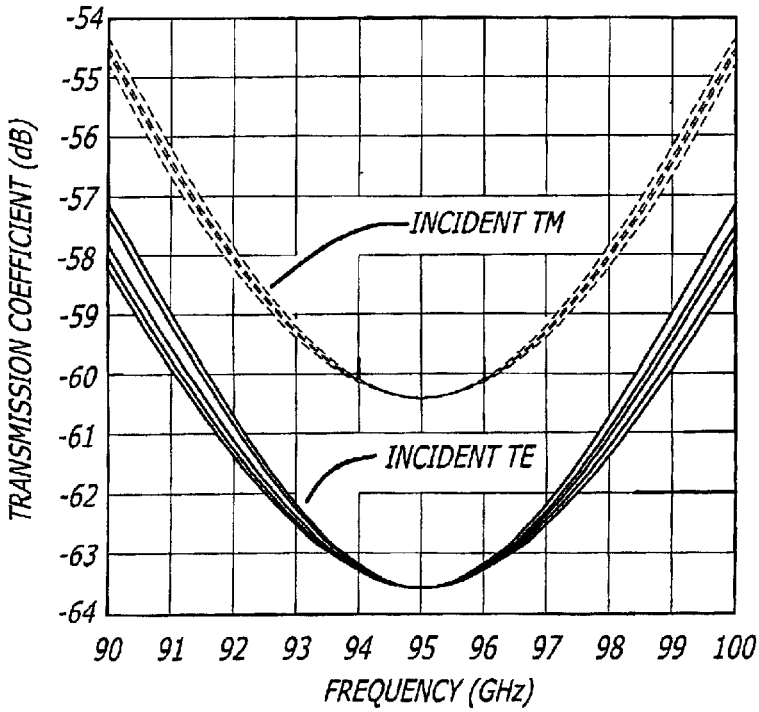
FIG. 3 is a graph showing the sensitivity of the transmission coefficient to variations in plate and gap dimensions.

FIG. 3 is a graph showing the sensitivity of the transmission coefficient to variations in plate and gap dimensions. The figure plots the transmission coefficient for five cases each for incident TE and TM waves in which the dimensions of each plate and each gap were allowed to vary randomly from case to case. The maximum allowed excursion from the nominal design value is 0.5 mils for each plate and 1 mil for each gap. In each case and for each dimension, the excursion is a uniformly distributed random number whose absolute value is less than or equal to the maximum allowed excursion. It is clear that such tolerances, which are easily achievable in practice, have little impact on the performance of the reflector.

As mentioned earlier, an arbitrarily polarized incident wave can be represented as a superposition of a TE and a TM wave incident at the same angle. If the angle of incidence is $\theta_{inc}$ and the projection of the electric field on the xy plane (see FIG. 1) makes an angle $\phi_{pol}$ with respect to the x axis, then the transmission coefficient can be expressed in terms of the transmission coefficients of the component TE and TM waves as $$T=T^{TM}\cos\phi_{pol}+T^{TE}\sin\phi_{pol}. \quad [14]$$

Note that $\phi_{pol}=0°$ if the incident wave is a TM wave and $\phi_{pol}=90°$ if the incident wave is a TE wave.

Figure 4:
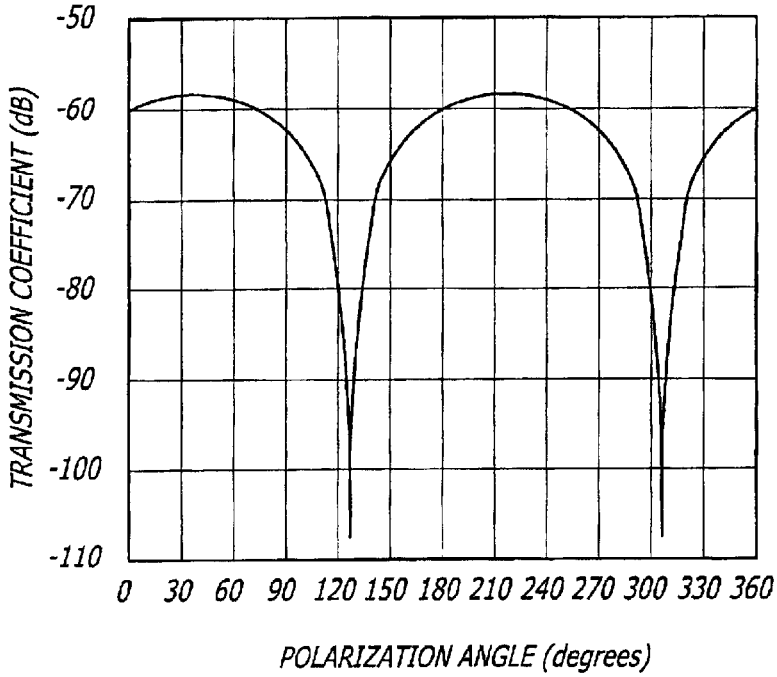
FIG. 4 is a graph showing the variation of the transmission coefficient with respect to polarization angle.

FIG. 4 is a graph showing the variation of the transmission coefficient with respect to polarization angle. One sees that as the polarization angle varies, the TE and TM contributions interfere constructively and then destructively. The transmission coefficient reaches a maximum value of −58.78 dB when $\phi_{pol}=35°$ and 215° and a minimum value of −108.25 dB when $\phi_{pol}=125.0°$ and 305.0°.

Figure 5:
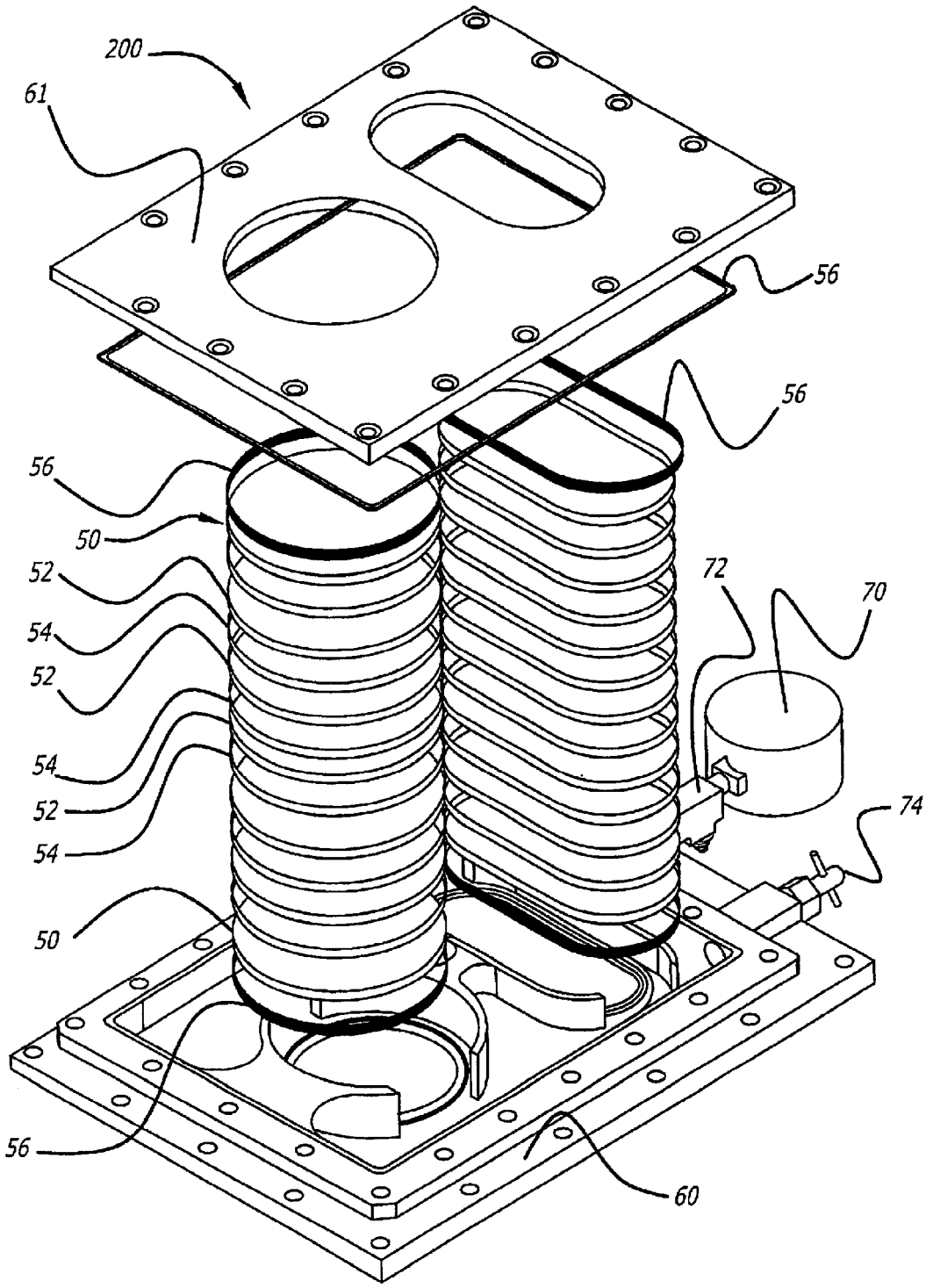
FIG. 5 is an exploded view of a prototype reflector designed in accordance with the teachings of the present invention.

FIG. 5 is an exploded view of a prototype reflector 200 designed in accordance with the teachings of the present invention. Two reflector assemblies of identical design are housed inside a hermetically sealed housing 60 with a front cover 61. O-ring seals 56 between the outermost sapphire plates 50 and the aluminum housing 60 and between the aluminum housing 60 and the front cover 61 prevent contaminants from entering from the outside. Vented metal spacers 54 maintain optimal spacing between neighboring plates (50, 52). A T and filler valve 72 and a pressure gauge 70 are attached to a gas fill port 84 (shown in FIG. 7) in the reflector housing 60, and a cutoff exhaust valve 74 is attached to an exhaust port 86 (shown in FIG. 7) in the reflector housing 60.

Figure 6:
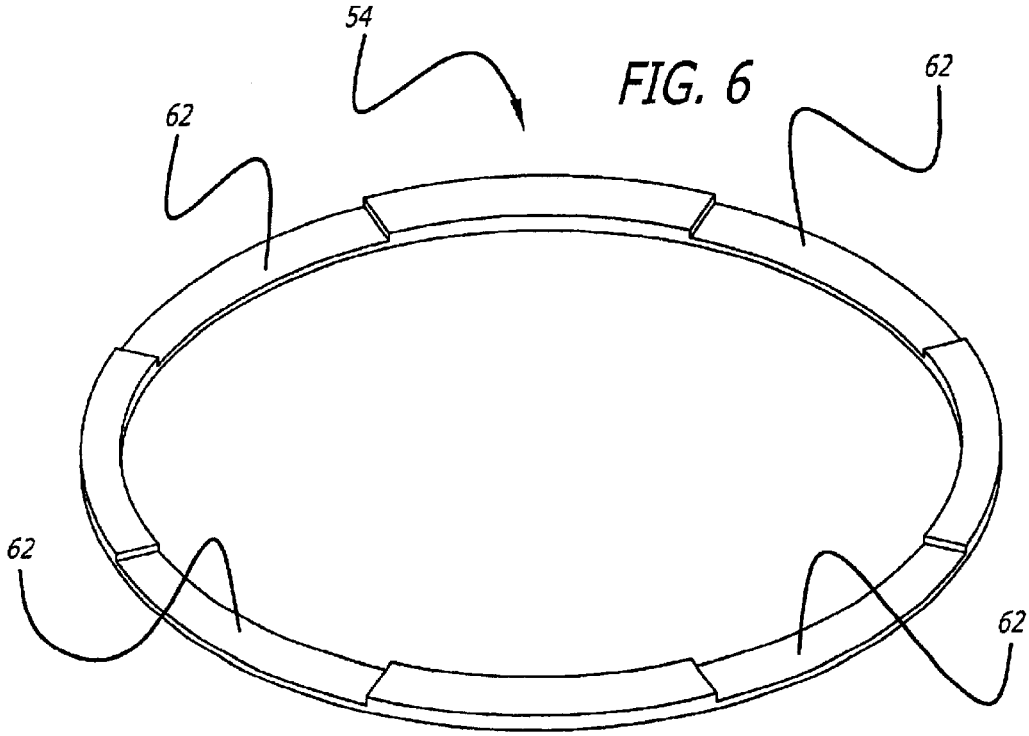
FIG. 6 is a detailed view of a circular vented metal spacer designed in accordance with the teachings of the present invention.

FIG. 6 is a detailed view of a circular vented metal spacer 54. The vents 62 allow gaseous contaminants to be displaced by dry nitrogen, with which the reflector assembly is filled during the sealing process. Of particular concern is water vapor, which if allowed to remain in the reflector could condense on the surfaces of the sapphire plates, obscuring the view through the reflector.

Figure 7:
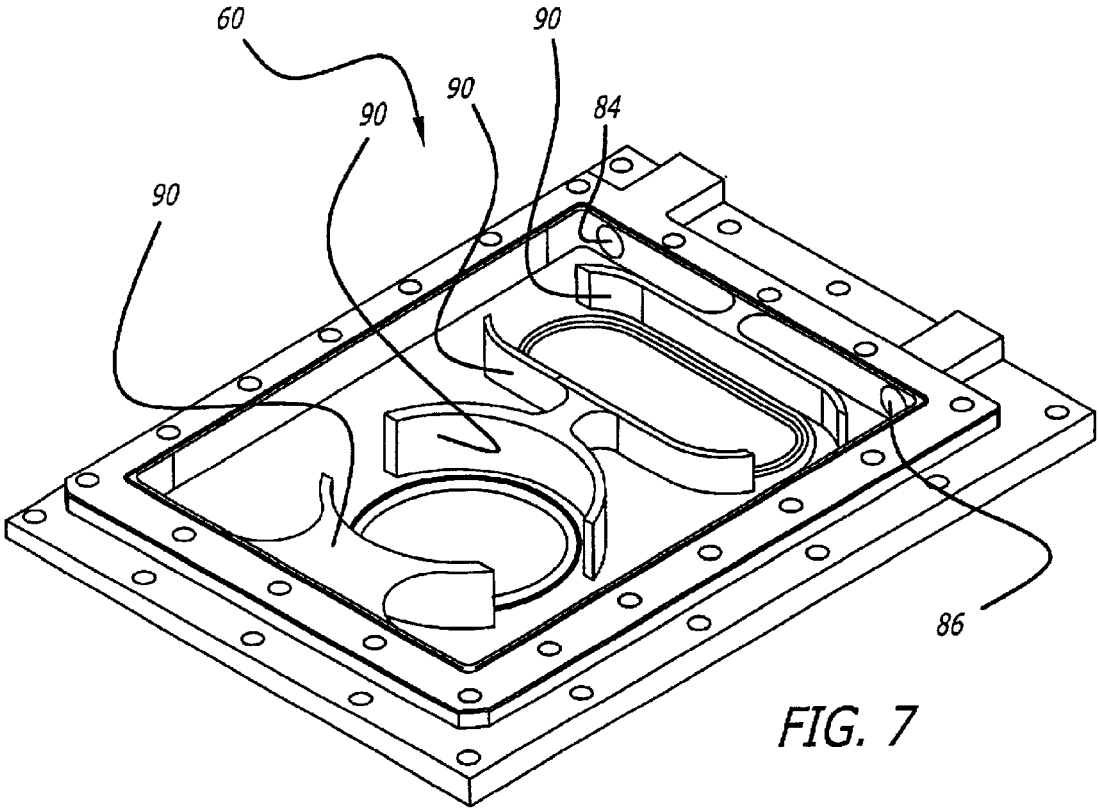
FIG. 7 is a detailed view of the interior of the reflector housing designed in accordance with the teachings of the present invention.

FIG. 7 is an interior view of the reflector housing 60, showing the gas fill port 84 and the exhaust port 86. Baffles 90 direct the flow of gas, preventing it from taking the path of least resistance (from the fill port 84 to the exhaust port 86), and forcing it to flow across the window surfaces, sweeping any contaminants out of the interior during the gas fill process.

Figure 8:
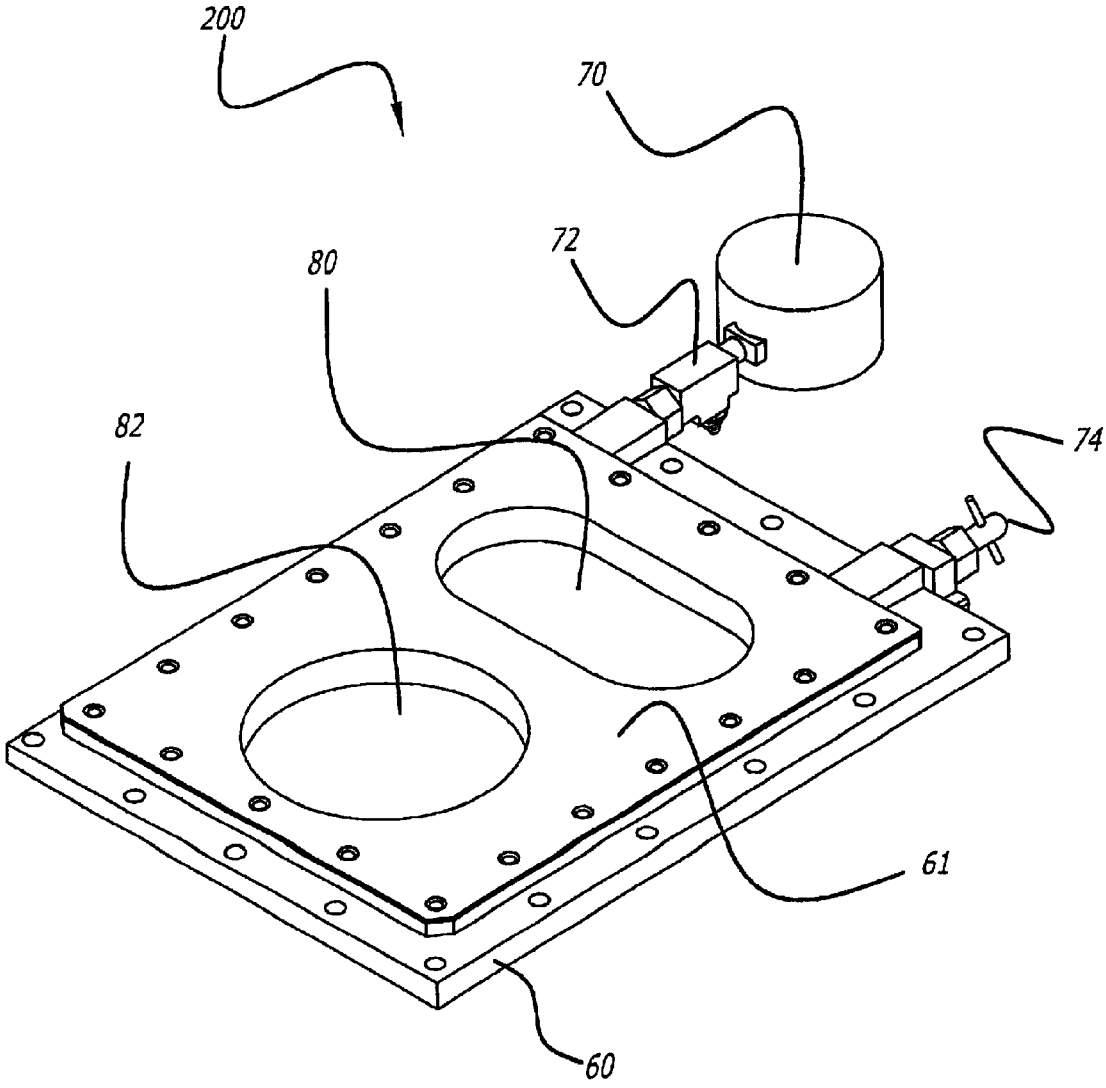
FIG. 8 is a front view of the assembled reflector designed in accordance with the teachings of the present invention.
Figure 9:
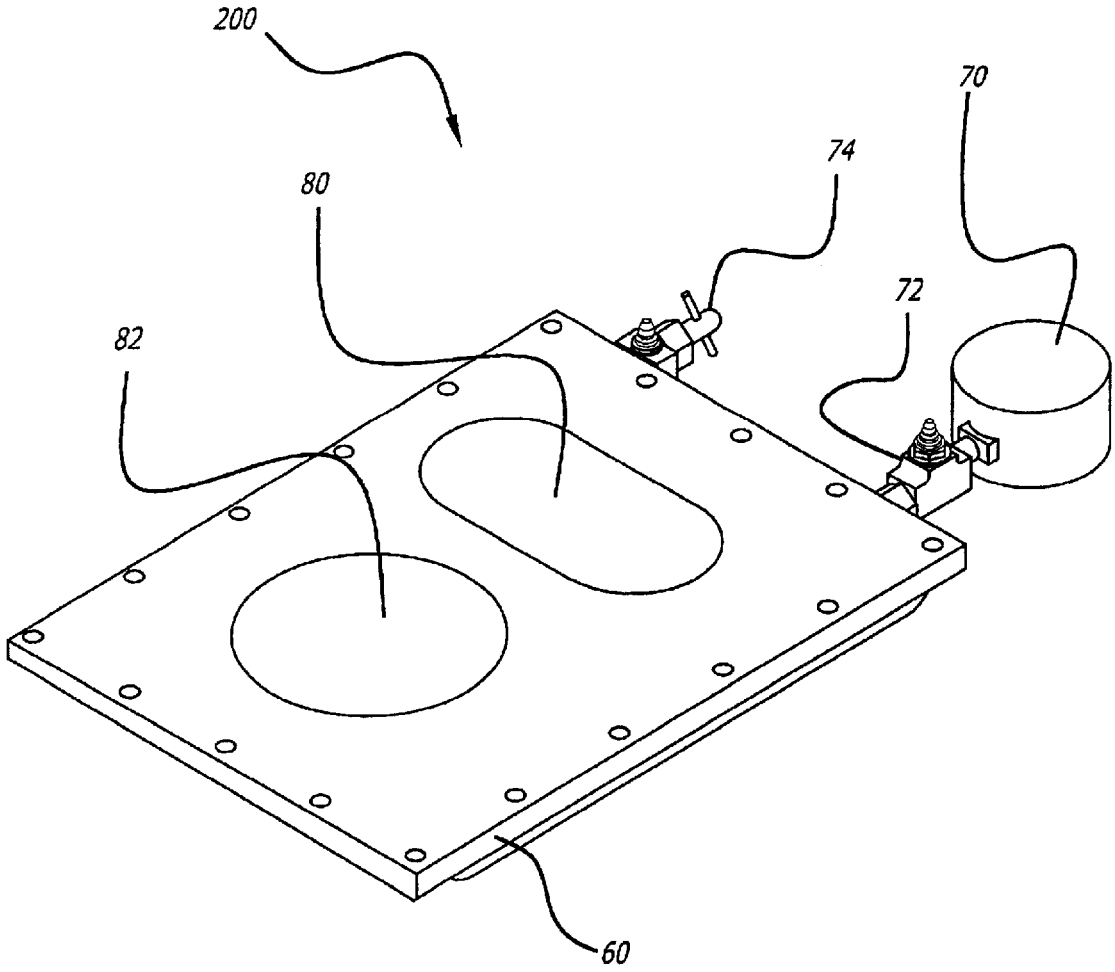
FIG. 9 is a rear view of the assembled reflector designed in accordance with the teachings of the present invention.

FIG. 8 is a front view of the assembled reflector 200 showing the first and second reflectors (80, 82) inside a sealed housing 60 with a front cover 61. FIG. 9 shows a rear view of the assembled reflector 200. Both figures show the T and filler valve 72 and the pressure gauge 70 attached to the gas fill port 84 (shown in FIG. 7), and the cutoff exhaust valve 74 attached to the gas exhaust port (shown in FIG. 7).

After the reflector 200 has been back-filled with dry nitrogen to a pressure of 1 psia, the valves attached to each port are closed. The pressure gauge 70 attached to the gas fill port 84 allows the gas pressure to be monitored during use. If the pressure falls below 0.25 psia, the gas supply should be refreshed and the pressure restored to its nominal value.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An apparatus for reflecting an incident millimeter-wave beam comprising:

a first layer of dielectric material adapted to receive and partially transmit said incident millimeter-wave beam;

one or more additional layers of dielectric material disposed in alignment with said first layer, each additional layer partially transmitting a wave received through a previous layer, and spacers disposed between said layers of dielectric materials to maintain air layers of predetermined uniform thickness between adjacent layers of dielectric material, wherein a thickness of each dielectric layer and said thickness of each air layer being such that waves of said millimeter-wave beam substantially cancel in the forward direction.

2. The invention of claim 1 wherein said dielectric materials are optically transparent.

3. The invention of claim 2 wherein said dielectric material is optical sapphire.

4. The invention of claim 3 wherein the number of sapphire layers is seven with six layers of air in between.

5. The invention of claim 4 wherein outer sapphire layers have a nominal thickness of 70.8 mils, inner sapphire layers have a nominal thickness of 30.4 mils, and air layers have a nominal thickness of 32.0 mils.

6. The invention of claim 1 wherein said spacers include vents for removing gaseous contaminants.

7. The invention of claim 1 wherein said apparatus further includes a sealed housing.

8. The invention of claim 7 wherein said sealed housing is filled with dry nitrogen.

9. The invention of claim 7 wherein said sealed housing includes a gas fill port for inputting gas.

10. The invention of claim 7 wherein said sealed housing includes a gas exhaust port for outputting gas.

11. The invention of claim 7 wherein said sealed housing includes baffles for directing the flow of gas.

12. An apparatus for reflecting an incident millimeter-wave beam comprising:

a first layer of dielectric material adapted to receive and partially transmit said incident millimeter-wave beam;

one or more additional layers of dielectric materials disposed in alignment with said first layer, each additional layer partially transmitting a wave received through a previous layer and a thickness of each layer being such that waves of said millimeter-wave beam substantially cancel in the forward direction;

a sealed housing for said layers with a gas fill port, a gas exhaust port, and baffles for directing gas flow;

a T and filler valve attached to said gas fill port; a pressure gauge attached to a first nozzle of said T and filler valve;

dry nitrogen applied to a second nozzle of said T and filler valve; and a cutoff exhaust valve attached to said gas exhaust port.

13. A method for reflecting an incident millimeter-wave beam including the steps of:

receiving said incident millimeter-wave beam with a first layer of dielectric material which partially transmits said wave and propagating said transmitted wave through one or more additional layers of dielectric material disposed in alignment with said first layer, said dielectric layers separated by air layers having a thickness maintained by spacer, wherein a thickness of each dielectric layer and each air layer being such that waves of said millimeter-wave beam substantially cancel in the forward direction.

* * * * *